United States Patent [19]

Pacht

[11] Patent Number: 4,690,325

[45] Date of Patent: Sep. 1, 1987

[54] HIGH PRESSURE FLUID DELIVERY SYSTEM

[75] Inventor: Amos Pacht, Houston, Tex.

[73] Assignee: Butterworth Jetting Systems, Inc., Houston, Tex.

[21] Appl. No.: 908,280

[22] Filed: Sep. 17, 1986

[51] Int. Cl.[4] ..... B05B 3/02

[52] U.S. Cl. ..... 239/124; 239/263.1; 239/264

[58] Field of Search ..... 239/248, 249, 565, 124, 239/246, 225.1, 263.1, 263.3, 264, 261

[56] References Cited

U.S. PATENT DOCUMENTS

| | | | |
|---|---|---|---|
| 3,831,845 | 8/1974 | Pacht | 239/76 |
| 3,834,621 | 9/1974 | Pacht et al. | 239/76 |
| 3,977,603 | 8/1976 | Magee, Jr. | 239/76 |
| 3,986,523 | 10/1976 | Pacht | 137/610 |
| 3,987,963 | 10/1976 | Pacht | 239/124 |
| 4,128,207 | 12/1978 | Pacht et al. | 239/186 |
| 4,219,155 | 8/1980 | Goerss | 239/124 |
| 4,278,101 | 7/1981 | Tanaka et al. | 239/248 |
| 4,439,954 | 4/1984 | Bennett | 239/246 |

FOREIGN PATENT DOCUMENTS

| | | | |
|---|---|---|---|
| 510676 | 10/1930 | Fed. Rep. of Germany | 239/246 |
| 501982 | 4/1920 | France | 239/246 |

*Primary Examiner*—Andres Kashnikow
*Assistant Examiner*—Karen B. Merritt
*Attorney, Agent, or Firm*—Hubbard, Thurman Turner & Tucker

[57] ABSTRACT

An improved high pressure fluid delivery system has a hollow fluid delivery shaft connected at its discharge end to a spray delivery assembly and rotationally driven relative to a hollow housing which internally supports the shaft. The discharge end of a high pressure fluid inlet adapter fitting and the inlet end of the shaft are sealingly interconnected within a seal cartridge removably carried by the housing in a readily accessible location, the inlet fitting and the seal cartridge being clamped to the housing by a cap member threaded onto the housing. High pressure fluid leakage past the seal cartridge into the housing is vented in a manner preventing significant internal fluid pressurization of the housing, thereby permitting it to be formed from a relatively lightweight material such as aluminum. High pressure fluid leakage past the seal cartridge toward the cap member is vented outwardly through a plurality of vent openings formed in the cap member.

25 Claims, 2 Drawing Figures

HIGH PRESSURE FLUID DELIVERY SYSTEM

BACKGROUND OF THE INVENTION

The present invention relates generally to high pressure fluid delivery systems, and more particularly provides a high pressure spray cleaning system having significantly improved sealing and venting means.

Various high pressure fluid delivery systems have heretofore been utilized to convert a flow of high pressure fluid (such as water at 6,000–10,000 psi or more), via nozzle means, to a high pressure spray used to clean a variety of objects. Systems of this general type are exemplified in U.S. Pat. Nos. 3,831,845; 3,834,621; 3,977,603; 3,986,523; and 4,128,207. Such systems typically comprise a hollow body into which the high pressure fluid is forced, and a hollow outlet member communicating with the interior of the body and operatively carrying at least one spray nozzle. A significant limitation of this type of high pressure fluid system is that because the fluid exerts a very high pressure on the interior of the body, the body must be of very strong, and therefore relatively heavy construction. Particularly in the case of large fluid delivery systems, this necessity can significantly increase the overall weight of the system.

Additionally, it is often desirable to provide for driven rotation of the nozzle support member relative to the body to clean interior surfaces or simply to expand the effective nozzle spray area. In the fluid delivery system disclosed in U.S. Pat. No. 3,987,963, this result is achieved by connecting the rotationally driven nozzle support member to a hollow fluid delivery shaft which is rotatably supported within the hollow body and has an inlet end rotatably sealed to the interior surface of the body. High pressure fluid is forced into the inlet end of the shaft, through the shaft interior, and outwardly through the hollow nozzle support member and a spray nozzle carried on the outer end of the support member for rotation therewith.

This construction is intended to isolate the fluid from the interior surface of the body which is intended merely to rotatably support the shaft portion disposed therein. During normal operation of the system, the body is indeed isolated from the high pressure of the supply fluid traversing the shaft. However, upon failure of the shaft seal, high pressure fluid can leak past the seal, along the shaft inlet portion and into the hollow body, thereby at least temporarily exposing the body's interior to essentially the full pressure of the supply fluid. Additionally, the positioning of the shaft-body seal renders it relatively inaccessible, and therefore fairly difficult to periodically inspect and replace.

Accordingly, it is an object of the present invention to provide an improved high pressure fluid delivery system of the general type described, which eliminates or substantially minimizes above-mentioned and other limitations and disadvantages associated with conventional systems.

SUMMARY OF THE INVENTION

In carrying out principles of the present invention, in accordance with a preferred embodiment thereof, an improved high pressure fluid delivery system is provided which incorporates a unique shaft-to-body sealing mechanism which is readily accessible and quickly removable, and a body venting system which vents high pressure fluid seal leakage in a manner preventing the body from being significantly pressurized by the supply fluid.

In a preferred embodiment thereof, the high pressure fluid delivery system of the present invention comprises a housing having intercommunicating first and second chambers, and a hollow, open-ended fluid delivery shaft extending through the first chamber and having an inlet end portion projecting into the second chamber, and an outlet end portion. Bearing means are positioned within the first chamber and support the shaft for rotation relative to the housing, the bearing means defining with the interior surface of the first chamber a subchamber interposed between the bearing means and the second chamber. A plurality of hollow, elongated spray arms are operatively connected to the outlet end portion of the fluid delivery shaft for rotation therewith and have connected at their outer ends high pressure spray nozzles. Motor and gear means are provided for rotating the shaft relative to the housing.

An inlet member is provided which has an inlet opening for receiving high pressure fluid from a source thereof, a discharge portion facing and spaced from the shaft inlet end portion and adapted to discharge high pressure fluid into and through the shaft, and an internal flow passage extending from the inlet opening outwardly through the discharge portion. Cartridge seal means are removably positioned in the second chamber and sealingly interconnect the inlet member discharge portion and the inlet end portion of the shaft. The inlet member and the cartridge seal means are captively associated with the housing by a closure cap member which is screwed onto the housing and clamps the inlet member and the seal cartridge means to the housing.

To prevent high pressure fluid leaking past the seal cartridge means, along the shaft inlet end portion and into the first housing chamber from significantly pressurizing the housing interior, the housing subchamber is directly vented by means of a vent opening extending outwardly through the housing from the interior surface of the housing subchamber. High pressure fluid leakage past the cartridge seal means toward the closure cap member is vented through a vent opening formed in the cartridge seal means and communicating with a plurality of vent openings extending outwardly through the closure cap.

The cartridge seal means are readily accessible for inspection and replacement by simply unscrewing the closure cap and lifting the cartridge seal means out of the second housing chamber. Because of the direct venting of the housing subchamber, the housing is protected from the high pressure of the supply fluid and may be formed from a lightweight material such as aluminum. In addition to venting high pressure fluid leakage past the cartridge seal means, the vent openings give visual indications of seal leakage.

In accordance with another aspect of the present invention, the bearing means comprise a spaced pair of annular ball bearing assemblies which define therebetween in the housing an annular lubrication subchamber which maybe filled with a suitable lubricant by means of a lubrication fitting installed on the housing. One of these bearing assemblies partially defines the first-mentioned housing subchamber and has an annular sealing element extending between its inner and outer races to provide a seal between the two housing subchambers. This seal cooperates with the housing vent passage to prevent high pressure seal leakage fluid from entering the lubrication subchamber.

DETAILED DESCRIPTION

Figures 1, 2:
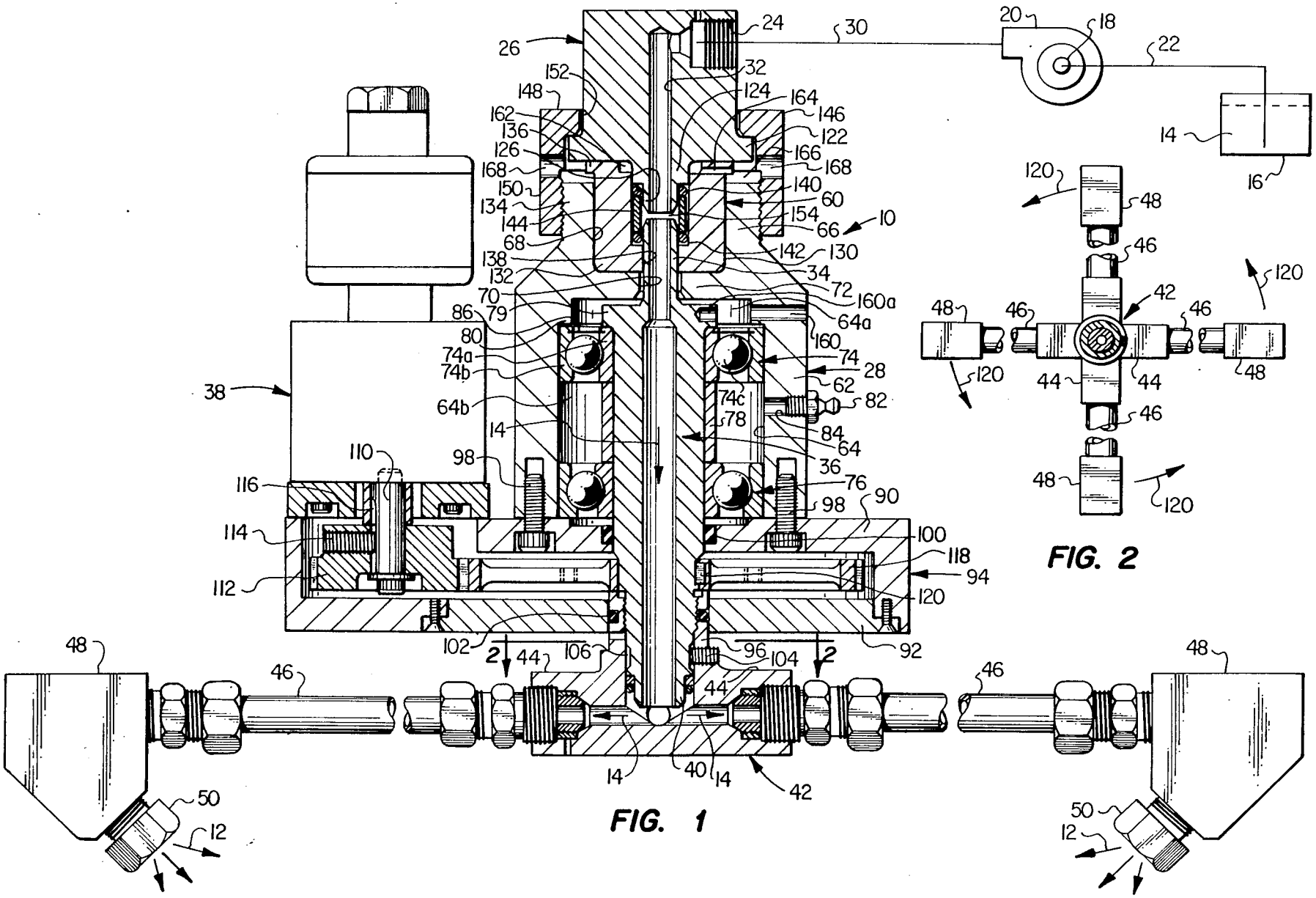
FIG. 1 is a partially cross-sectioned and fragmented view of an improved high pressure fluid delivery system embodying principles of the present invention, with portions thereof being schematically depicted.
FIG. 2 is a reduced scale cross-sectional view taken through the system along line 2—2 of FIG. 1.

Illustrated in FIGS. 1 and 2 is an improved high pressure fluid delivery system 10 which is utilized to convert a flow of high pressure fluid (for example, water having a maximum pressure exceeding approximately 5,000 psi) to a high pressure spray 12 which may be utilized to clean a variety of objects. The basic operating format of system 10 is as follows. Water 14 from a suitable source 16 thereof is drawn into the inlet 18 of a high pressure pump 20 via an inlet pipe 22. Pump 20 discharges a flow of high pressure water into the inlet opening 24 of an inlet adapter fitting 26, secured to a hollow housing 28, via a discharge pipe 30. The high pressure water received by the inlet fitting 26 is forced downwardly through an internal flow passage 32 therein into an upper or inlet end portion 34 of a hollow, open-ended fluid delivery shaft 36 which is rotatably supported within housing 28 and rotationally driven relative thereto by an air motor 38. A lower or outlet end portion 40 of shaft 36 has fixedly secured thereto a hollow fluid discharge hub member 42 which has connected thereto four outwardly projecting hollow tubular arm portions 44, each of which internally communicates with the open outlet end 40 of shaft 36 via the interior of the hub. Threaded into the open outer ends of the arm portions 44 are four fluid supply tubes 46. Secured to the outer end of each of the supply tubes 46 is a hollow nozzle support member 48 which operatively carries, in a downwardly and inwardly canted orientation, a high pressure spray nozzle 50. During operation of system 10, high pressure water 14 is forced downwardly through the rotating shaft 36, and outwardly through the nozzles 50 as high pressure spray 12, via the spinning hub 42, supply tubes 46 and nozzle support members 48.

As will be seen, the present invention provides significantly improved sealing means between the inlet adapter fitting 26 and the shaft inlet end portion 34, such sealing means being readily accessible for rapid removal and replacement. It will additionally be seen that the present invention uniquely provides means for venting high pressure fluid leakage from seal means 60 in a manner which protects the housing 28 from high internal fluid pressure, thereby allowing the housing to be formed from a relatively lightweight material such as aluminum.

Housing 28 is of a generally cylindrical configuration, and has a vertically extending, annular base wall portion 62 which defines a cylindrical first chamber 64 within the housing. Adjacent the upper end of the base wall portion 62, the housing exterior wall surface slopes upwardly and inwardly to a reduced diameter, exteriorily threaded cylindrical upper end portion 66. A central cylindrical bore 68 is formed downwardly through the upper end portion 66 of the housing and defines therein a second chamber 68 which communicates with the lower chamber 64 via a central circular opening 70 formed through a housing dividing wall 72 interposed between the two chambers.

Shaft 36 extends upwardly through the housing chamber 64 with the shaft inlet end portion 34, which is of a substantially smaller diameter than the balance of the shaft, extending through the dividing wall opening 70 and projecting into the upper chamber 68, the opening 70 being of a slightly larger diameter than the shaft portion 34. Shaft 36 is supported for rotation relative to the housing 28 by means of upper and lower annular ball bearing assemblies 74 and 76 disposed within chamber 64 and vertically spaced apart by an annular spacer 78 which circumscribes the shaft 36. The inner race **74*a* of bearing 74 abuts the downwardly facing surface of an annular shaft flange 79 disposed beneath the dividing wall 72, while the outer race 74*b* of bearing 74 abuts the downwardly facing surface of an annular interior shoulder portion 80** of the housing.

As illustrated in FIG. 1, the upper end of bearing 74 defines with the interior surface of housing chamber 64 a generally annular subchamber **64*a* interposed between the dividing wall 72 and the bearing 74. The bearings 74, 76 define therebetween in the chamber 64 an annular lubrication subchamber 64*b* which may be filled with a suitable lubricant via a lubrication fitting 82 threaded into an opening 84 formed through the housing wall 62 between the upper and lower bearings. An annular sealing member 86 extending between the inner and outer races 74*a*, 74*b* of bearing 74 above its ball bearings 74*c* provides a seal between the subchambers 64*a* and 64*b* to prevent transfer of water or lubricant across the upper bearing 74**.

The upper bearing 74 is a radial bearing, but the lower bearing 76 is a thrust bearing of the "angular-contact" type designed to accept both radial and axial thrust loads. Accordingly, lower bearing 76 accepts the axial thrust load imposed on the shaft 36 by the high pressure fluid force on its upper end. The unique use of an angular-contact type bearing in conjunction with the pure radial bearing as illustrated provides a particularly compact radial-and-thrust bearing structure within the housing 28.

As illustrated in FIG. 1, a lower end portion of the shaft 36 extends downwardly through the upper and lower walls 90, 92 of a hollow gear housing 94, such lower end portion of the shaft projecting downwardly from the lower housing wall 92 and being threaded into a vertically extending hollow central cylindrical inlet portion 96 of the discharge hub 42. The lower end of the housing 28 is secured to the upper gear housing wall 90 by bolts 98. Shaft 36 is rotationally sealed to upper housing wall 90 by a suitable annular seal 100, while the cylindrical hub member portion 96 is rotatably sealed to the lower housing wall 92 by an annular seal 102. The upper hub portion 96 is further secured to the outlet end portion of shaft 36 by a small set screw 104 extending through hub portion 96 into an annular groove 106 formed in the periphery of lower shaft end portion 40.

Air motor 38 is suitably secured to the upper gear housing wall 90 and has an output shaft 110 which extends into the interior of the gear housing and is rotationally locked to a small driving gear 112 therein by means of a set screw 114 extending through gear 112 into a longitudinally extending slot 116 formed on the shaft 110. Gear 112 meshes with a larger diameter driven gear 118 disposed within the gear housing and rotationally locked to the fluid delivery shaft 36 by means of a small key member 120. Rotation of the motor shaft 110 causes rotation of the fluid delivery shaft 36 relative to the housings 28, 94 and concomitant rotation (as indicated by the arrows 120 in FIG. 2) of the spray delivery assembly defined by the hub 42, the supply tubes 46, the nozzle support members 48 and the spray nozzles 50. If desired, the annular shaft seal 100 could be deleted, and a suitable passage extending between subchamber 64*b* and the interior of gear housing 94 substituted therefor, so that lubricant forced into subchamber 64*b* via the fitting 82 would also be forced into the gear housing to lubricate the gears therein.

The inlet adapter fitting 26 has a generally cylindrical configuration and has, adjacent its lower end, an annular external flange 122. Projecting downwardly from flange 122 is a reduced diameter cylindrical hub 124 having a still smaller diameter cylindrical outlet portion 126 projecting downwardly therefrom. The downwardly extending inlet member passage 32 opens outwardly through the lower end of discharge portion 126 which projects downwardly into the upper housing chamber 68 and is positioned in a spaced, facing relationship with the open upper end of the inlet end portion 34 of the hollow shaft 36, discharge portion 126 having an outer diameter equal to the outer diameter of the upper shaft end portion 34. It can be seen that discharge portion 126 is positioned to force high pressure water discharged therefrom into the inlet end portion 34 of the fluid delivery shaft 36.

The sealing means 60 include a hollow, cylindrical seal cartridge 130 which is removably received in the upper housing chamber 68, the cartridge having a lower end wall 132 which abuts the upper surface of the dividing wall 72, and a hollow cylindrical body portion 134 which projects upwardly from the wall 132. Cartridge body 134 has, at its upper end, an annular external flange 136 which is spaced upwardly from the upper end of the threaded upper end portion 66 and abuts the inlet adapter flange 122. The inlet end portion 34 of shaft 36 is rotatably received in a circular bore 138 formed through the bottom cartridge wall 132 and, like the discharge portion 126 of the inlet adapter 26, projects into the interior of the seal cartridge 130 with a lower end portion of adapter hub being received in an upper end portion of the cartridge interior.

Positioned within the interior of seal cartridge 130 are an upper annular seal member 140, which forms an annular seal between the discharge portion 126 and the interior of the seal cartridge 130, and a lower annular seal member 142 which forms an annular seal between the inlet end portion 34 of shaft 36 and the interior surface of the seal cartridge. Seals 140, 142 are vertically spaced apart by a suitable annular seal spacer member 144 disposed within the seal cartridge interior and circumscribing the facing portions of elements 34 and 126.

The inlet adapter member 26 and the seal cartridge 130 are clamped to the housing 28 by means of a generally annular retaining or closure cap 146 having an upper end wall 148 and an interiorly threaded annular wall depending therefrom which is screwed onto the threaded upper end portion 66 of the housing 28. End wall 148 has a large, central circular opening 152 formed therethrough which outwardly circumscribes a portion of the inlet fitting immediately above the inlet fitting flange 122. The inlet fitting flange 122 and the seal cartridge 130 are disposed within the cap 146, the cap endwall 148 bearing against the inlet fitting flange 122 which in turn bears against the seal cartridge upper flange 136.

The seal means 60, which interconnect the discharge portion 126 and the shaft inlet end 34 with a sealed fluid passageway 154, are easily accessible for inspection, removal and replacement of the seals 140, 142 by simply unscrewing the retainer cap 146 and lifting the seal cartridge 130 out of the housing chamber 68. During normal operation of the system 10, the seal means 60 function to completely isolate the housing 28 from the high pressure of the water 14 downwardly traversing the rotating fluid delivery shaft 36. This allows the housing 28 to function merely as a support member for the bearings 74 and 76, and other system components carried by the housing, thus allowing the housing 28 to be formed from a relatively light-weight material such as aluminum.

However, it can be seen that in the event of failure of the lower cartridge seal 142, high pressure water can be forced downwardly between the seal 142 and the upper shaft portion 34 into the interior of the housing 28, thereby potentially subjecting the housing to and internal fluid pressure of at least 5,000 psi. This potential high internal pressurization of the housing 28 is uniquely avoided in the present invention by the provision of a vent opening 160 which extends laterally outwardly through the housing wall 62 from the interior surface of the subchamber 64*a*. The vent opening 160 functions to directly vent subchamber 64*a* to limit potential fluid pressure therein, and to further prevent high pressure fluid entering such subchamber from being forced downwardly across the inner and outer annular peripheries of bearing 74 into the lubrication subchamber 64*b*.

Extending radially inwardly through the periphery of the shaft flange 79 is a circular bore 160*a* which is vertically aligned with the laterally extending vent passage 160. Bore 160*a*facilitates removal the hub 42 from the shaft 36, or its attachment thereto, in the following manner. With bore 160*a* facing the vent passage 160 a suitable rod or other locking member (not shown) may be inserted inwardly through vent passage 160 and into the bore 160*a* to thereby rotationally lock the shaft 36 relative to the housing 28. With the shaft rotationally locked in this manner, the hub 42 may be easily screwed onto the lower end of shaft 36 or unscrewed therefrom.

Additional means are provided for venting the seal cartridge 130 in the event that the upper cartridge seal 140 begins to leak. Specifically, upward fluid leakage across seal 140, between such seal and the interior surface of the seal cartridge 130, is forced upwardly into a small annular chamber 162 positioned between the cartridge flange 136 and the inlet fitting hub 124, and then outwardly through a vent opening 164 formed through the cartridge flange 136. High pressure fluid leakage exiting the vent passage 164 enters a small annular chamber 166 defined between the cartridge 130 and the cap wall 150 directly above the upper housing end portion 66, and is discharged through a plurality of vent openings 168 formed through the annular cap body 150. In addition to performing the previously described leakage venting functions, the vent openings 160 and 168 also provide an easy visual indication of failure of a seal portion of the seal means 60.

It can be seen from the foregoing that the present invention provides a significantly improved, and more readily accessible, seal mechanism between the stationary inlet member 26 and the rotating shaft 36. Additionally, the seal means 60 effectively isolate the housing 28 from the very high pressure of the water 14. Moreover, by virtue of the housing vent opening 160, the housing is protected from such high fluid pressure even during periods of seal failure.

The foregoing detailed description is to be clearly understood as given by way of illustration and example only, the spirit and scope of this invention being limited solely by the appended claims.

What is claimed is:

1. High pressure fluid delivery apparatus comprising:

(a) wall means defining a housing having intercommunicating first and second chambers;

(b) a hollow, open-ended fluid delivery shaft extending through said first chamber, said shaft having an inlet end portion projecting into said second chamber, and an outlet end portion;

(c) bearing means, positioned within said first chamber, for supporting said shaft for rotation relative to said housing, said bearing means defining with the interior surface of said first chamber a subchamber interposed between said bearing means and said second chamber;

(d) means for rotating said shaft relative to said housing;

(e) means, carried by said outlet end portion of said shaft for rotation therewith, for converting high pressure fluid discharged from said outlet end portion of said shaft to a high pressure spray;

(f) an inlet member having an inlet opening for receiving high pressure fluid from a source thereof, a discharge portion facing and spaced from said inlet end portion of said shaft and adapted to discharge high pressure fluid into and through said shaft, and an internal flow passage extending from said inlet opening outwardly through said discharge portion;

(g) seal means, removably positioned in said second chamber, for sealingly and rotatably interconnecting facing portions of said inlet end portion of said shaft and said discharge portion of said inlet member;

(h) means, removably connected to said housing, for captively associating said inlet member and said seal means with said housing; and (i) means for directly venting said subchamber to limit fluid pressure within said housing caused by leakage of high pressure fluid past said seal means into said housing.

2. The apparatus of claim 1 wherein said means for directly venting said subchamber comprise a vent passage extending outwardly through said housing from the interior surface of said subchamber.

3. The apparatus of claim 2 further comprising means for selectively rotationally locking said shaft to said housing.

4. The apparatus of claim 3 wherein said means for selectively rotationally locking said shaft to said housing comprise an external depression formed in said shaft and alignable with said vent passage, whereby a locking member may be inserted through said vent passage and into said external depression to thereby prevent rotation of said shaft relative to said housing.

5. The apparatus of claim 1 wherein said seal means comprise a seal cartridge removably positioned in said second chamber, and wherein said means for captively associating said inlet member and said seal means with said housing include a cap member threaded to said housing and clamping said inlet member and said seal cartridge to said housing.

6. The apparatus of claim 5 further comprising means for venting high pressure fluid leaking outwardly through said seal cartridge toward said cap member.

7. The apparatus of claim 6 wherein said means for venting high pressure fluid leaking outwardly through said seal cartridge toward said cap member include intercommunicating vent openings formed through said seal cartridge and said cap member.

8. The apparatus of claim 1 wherein said bearing means include first and second annular ball bearing assemblies spaced apart along said shaft within said first chamber and defining therebetween a lubrication subchamber, said first annular ball bearing assembly defining a portion of said first-mentioned subchamber and operatively carrying seal means defining with said first annular ball bearing assembly a seal between said first-mentioned subchamber and said lubrication subchamber.

9. The apparatus of claim 8 wherein said first annular ball bearing assembly is a radial bearing and said second annular ball bearing assembly is an angular-contact thrust bearing.

10. The apparatus of claim 1 wherein said means for converting high pressure fluid include a hollow hub secured to said outlet end of said shaft for rotation therewith, a plurality of hollow tubular arm members each connected at one end to said hub, communicating with its interior and projecting outwardly therefrom in a direction generally transverse to said shaft, and a plurality of high pressure spray nozzles operatively connected to the outer ends of said arm members.

11. High pressure fluid delivery apparatus comprising:

(a) inlet means having an inlet portion for receiving high pressure fluid from a source thereof, and a discharge portion for discharging the received fluid;

(b) a hollow housing having a wall with an opening therein;

(c) means for mounting said inlet means on said housing;

(d) hollow fluid delivery shaft means extending through the interior of said housing, said shaft means having an inlet end portion projecting outwardly through said housing wall opening and positioned in a spaced, facing relationship with said discharge portion of said inlet means, and an outlet end portion;

(e) wall means extending outwardly from said housing wall and circumscribing said housing wall opening, said inlet end portion of said shaft means and said discharge portion of said inlet means;

(f) means defining a seal between said wall means and said discharge portion of said inlet means;

(g) means defining a seal between said wall means and said inlet end portion of said shaft means;

(h) means carried by said outlet end portion of said shaft means for converting high pressure fluid discharged therefrom to a high pressure spray;

(i) bearing means, disposed in said housing and defining therein a subchamber interposed between said bearing means and said housing wall, for supporting said shaft means for rotation relative to said housing and said inlet means;

(j) means for rotating said shaft means relative to said housing and said inlet means; and (k) a vent opening extending outwardly through said housing from the interior surface of said subchamber.

12. The apparatus of claim 11 further comprising means for selectively rotationally locking said shaft means to said housing.

13. The apparatus of claim 12 wherein said means for selectively rotationally locking said shaft means to said housing comprise an external depression formed in said shaft means and alignable with said vent opening, whereby a locking member may be inserted through said vent opening and into said external depression to thereby prevent rotation of said shaft means relative to said housing.

14. The apparatus of claim 11 wherein said seal-defining means (f) and (g) comprise a seal cartridge removably received within said wall means.

15. The apparatus of claim 14 wherein said wall means are integral with said housing.

16. The apparatus of claim 15 wherein said means for mounting said inlet means on said housing comprise a cap member removably secured to said housing and captively retaining said inlet means and said seal cartridge thereon.

17. The apparatus of claim 11 further comprising means defining a vent passage extending outwardly through said means for mounting said inlet means on said housing from said seal-defining means (f).

18. The apparatus of claim 11 wherein said means for rotating said shaft means comprise a gear housing secured to said housing and through which said shaft means extend, motor means carried by said gear housing, and gear means disposed in said gear housing and operatively interconnected between said motor means and said shaft means.

19. The apparatus of claim 11 wherein said means carried by said outlet end portion of said shaft means comprise a hollow hub secured to said outlet end portion of said shaft means for rotation therewith, a plurality of hollow tubular arm members each connected at one end to said hub, communicating with its interior and projecting outwardly therefrom in a direction generally transverse to said shaft, and a plurality of high pressure spray nozzles operatively connected to the outer ends of said arm members.

20. The apparatus of claim 11 wherein said bearing means comprise a radial bearing circumscribing said shaft means, and a thrust bearing circumscribing said shaft means and spaced apart from said radial bearing along said shaft means.

21. The apparatus of claim 11 wherein said thrust bearing is an annular-contact type thrust bearing.

22. High pressure fluid delivery apparatus comprising:

(a) wall means defining a housing having intercommunicating first and second chambers;

(b) a hollow, open-ended fluid delivery shaft extending through said first chamber, said shaft having an inlet end portion projecting into said second chamber, and an outlet end portion;

(c) bearing means, positioned within said first chamber, for supporting said shaft for rotation relative to said housing, said bearing means defining with the interior surface of said first chamber a subchamber interposed between said bearing means and said second chamber, said bearing means comprising a radial bearing circumscribing said shaft, and a thrust bearing circumscribing said shaft and spaced apart from said radial bearing along said shaft;

(d) means for rotating said shaft relative to said housing;

(e) means, carried by said outlet end portion of said shaft for rotation therewith, for converting high pressure fluid discharged from said outlet end portion of said shaft to a high pressure spray;

(f) an inlet member having an inlet opening for receiving high pressure fluid from a source thereof, a discharge portion facing and spaced from said inlet end portion of said shaft and adapted to discharge high pressure fluid into and through said shaft, and an internal flow passage extending from said inlet opening outwardly through said discharge portion;

(g) seal means, removably positioned in said second chamber, for sealingly and rotatably interconnecting facing portions of said inlet end portion of said shaft and said discharge portion of said inlet member; and (h) means, removably connected to said housing, for captively associating said inlet member and said seal means with said housing.

23. The apparatus of claim 22 further comprising means for directly venting said subchamber to limit fluid pressure within said housing caused by leakage of high pressure fluid past said seal means into said housing.

24. The apparatus of claim 22 wherein said thrust bearing is an angular-contact type thrust bearing.

25. The apparatus of claim 22 wherein said radial bearing is positioned between said thrust bearing and said seal means.

* * * * *